US005236275A

United States Patent [19]

Kneeland et al.

[11] Patent Number: 5,236,275

[45] Date of Patent: Aug. 17, 1993

[54] PAVEMENT PATCHING APPARATUS AND METHOD

[76] Inventors: Reginald J. Kneeland, 10268 Brookston Ct., Manassas, Va. 22110; Ghassan A. Radwan, 1754 Gilson St., Falls Church, Va. 22043

[21] Appl. No.: 751,408

[22] Filed: Aug. 28, 1991

[51] Int. Cl.[5] ..... E01C 19/00

[52] U.S. Cl. ..... 404/75; 404/107; 404/110; 404/133.2

[58] Field of Search ..... 404/75, 107, 108, 110–112, 404/122, 127, 128, 133.2

[56] References Cited

U.S. PATENT DOCUMENTS

| | | | |
|---|---|---|---|
| 3,217,620 | 11/1965 | Mindrum et al. | 404/133.2 X |
| 3,625,120 | 12/1971 | Nagy | 404/122 X |
| 4,302,127 | 11/1981 | Hodson | 404/108 X |
| 4,423,980 | 1/1984 | Warnock | 404/111 X |
| 4,511,284 | 4/1985 | Sterner | 404/111 |
| 4,579,479 | 4/1986 | Bryant | 404/107 X |
| 4,676,689 | 6/1987 | Yant | 404/133.2 X |
| 4,704,046 | 11/1987 | Yant | 404/110 X |
| 4,830,533 | 5/1989 | Miller | 404/101 |
| 5,006,012 | 4/1991 | Sterner | 404/107 |
| 5,131,788 | 7/1992 | Huliesko | 404/108 |

FOREIGN PATENT DOCUMENTS

| | | |
|---|---|---|
| 2528085 | 12/1982 | France . |
| 2576336 | 7/1986 | France . |

*Primary Examiner*—Ramon S. Britts
*Assistant Examiner*—Roger J. Schoeppel
*Attorney, Agent, or Firm*—James Creighton Wray

[57] ABSTRACT

A pavement patcher has a frame supported on the back of a truck. An operator's platform is movable horizontally and transversely on the frame across the back of the truck, and longitudinally for a short distance. The platform carries a hydraulic control console and a blacktop hopper with a hydraulic rotor and an auger. The platform also carries a steel roller mounted on hydraulic rams. The truck driver stops with the frame over a hole. The operator riding on the platform positions the side delivery opening at the bottom of the hopper next to the hole and operates the auger to dispense the required amount of blacktop. The operator then extends the rams to lower the roller and moves the platform to roll the roller across the patch. Significant force is developed on the roller from the hopper's platform, carriage, frame and truck to seal the patch. A hydraulic package is mounted at a side of the frame with a motor, pump and reservoir.

11 Claims, 4 Drawing Sheets

PAVEMENT PATCHING APPARATUS AND METHOD

BACKGROUND OF THE INVENTION

Patching-potholes is a widely practiced process, particularly in areas where ground freezes. Potholes develop as moisture below a road freezes, lifting a part of the road. That leaves the previously frozen portion unsupported and traffic may break the road. Potholes develop, which may be enlarged by further traffic. Patching is ordinarily done by a crew of three, a driver and two men with shovels who shovel cold patching material into the potholes from the back of a truck. When the potholes are filled with the cold patch material, it is left to traffic to pack the material in the holes. In fact, traffic lifts the material from the holes, resulting in a quick recreation of the potholes.

When potholes are partially filled or are not sealed or are improperly sealed, moisture collects in the holes. The moisture creates the freeze-thaw cycle in the following cold season. Often the same potholes reopen in the spring.

Patching potholes is slow, expensive and difficult work and requires a three-man crew.

Some attempts have been made to provide small independent pothole-patching vehicles, without success.

Reduction of crew required for patching potholes is a constant goal of governments who are charged with the maintenance of roadways.

The complexities of scheduling and the expense of three-man crews dictate that better, less labor-intensive methods be found for pothole patching.

SUMMARY OF THE INVENTION

The invention is designed to enhance and advance the repair of potholes in roads made from flexible pavement. The platform consists of a steel structure that is hung from the back of a truck and can be dismantled during the off-season work schedule. The platform carries a hopper, steel roller, hydraulic pump, control panel, and the person operating the control. The truck driver adjusts the longitudinal location, whereas the platform operator adjusts the traverse location over the pothole to be repaired.

A pavement patcher has a frame supported on the back of a truck. An operator's platform is movable horizontally and transversely on the frame across the back of the truck, and longitudinally for a short distance. The platform carries a hydraulic control console and a blacktop hopper with a hydraulic rotor and an auger. The platform also carries a steel roller mounted on hydraulic rams. The truck driver stops with the frame over a hole. The operator riding on the platform positions the side delivery opening at the bottom of the hopper next to the hole and operates the auger to dispense the required amount of blacktop. The operator then extends the rams to lower the roller and moves the platform to roll the roller across the patch. Significant force is developed on the roller from the hopper platform, carriage, frame and truck weights to seal the patch. A hydraulic package is mounted at a side of the frame with a motor, pump and reservoir, or taken from the truck hydraulic system with an extension to the platform with a quick disconnect.

A pavement patching apparatus of the invention has a frame for supporting on a back of a truck. An operator's platform is movably mounted on the frame for moving the platform horizontally across the frame, transversely along the back of the truck, and for moving the platform longitudinally with respect to the truck for a relatively shorter distance. A hydraulic control console and a blacktop hopper are mounted on the platform. A hydraulic rotor is connected to the hopper, and an auger is connected to the hydraulic rotor and is mounted within the hopper for moving the blacktop material through the hopper as the hydraulic rotor rotates. A side delivery opening at the bottom of the hopper chute dispenses blacktop from the hopper into a pavement pothole. A hydraulic roller mounted on the platform is extended below the platform into contact with blacktop atop the hole for pressing the blacktop into the hole under the pressure of the roller and its supporting structure.

Preferably the frame has a mounting portion which is connected to the truck. A platform portion of the frame is mounted on an end of the truck-connected portion and extends generally horizontally below a plane of the truck bed.

In a preferred embodiment, a shelf on the frame mounts the hydraulic package, which includes a pump and a reservoir and a motor and servo valves, on one end of the platform portion of the frame along one edge of the truck. (Note: See page 3 for comments.)

Preferably the platform portion of the frame has first and second parallel rails, and first and second carriages respectively mounted in the rails.

The preferred platform further first and second slides having opposite ends connected to the first and second carriages for moving the spaced slides transversely across the back of the truck on the rails of the platform portion of the frame.

Preferably the platform is mounted on the slides on captured bearing wheels for allowing forward and aft movement of the platform on the slides without tipping.

The preferred platform includes an operator's stand, and the hopper includes a vertical chute with an upper opening for receiving blacktop from a bed of the truck. Preferably the control console is mounted on an upper end of the chute. The stand and the chute and the console move back and forth with the platform on the slides.

In a preferred embodiment, first and second parallel links have first ends connected to front and rear sides of the chute near a bottom thereof. The roller has an axle connected to second ends of the first and second links for pivoting on the links with respect to the lower end of the chute. Rams connected to the axle of the roller and to the platform respectively lift the roller away from pavement and force the roller toward the pavement against the downward pressure from the platform and frame and truck for sealing blacktop deposited in a pothole.

The invention provides a method of filling potholes from a hopper on a truck bed by driving a truck into position where a pothole is in back of a truck. A platform, hopper and chute are moved transversely across the truck until the opening at a bottom of the chute is aligned with a pothole. Blacktop is released from the chute. A roller is lowered onto the surface of the blacktop. Pressing the roller in the direction of the pavement and moving the roller, chute and platform transversely with respect to the truck seals the blacktop in the pothole.

These and further and other objects and features of the invention are apparent in the disclosure, which includes the above and ongoing written specification, with the claims and the drawings.

DETAILED DESCRIPTION OF THE DRAWINGS

Figure 1:
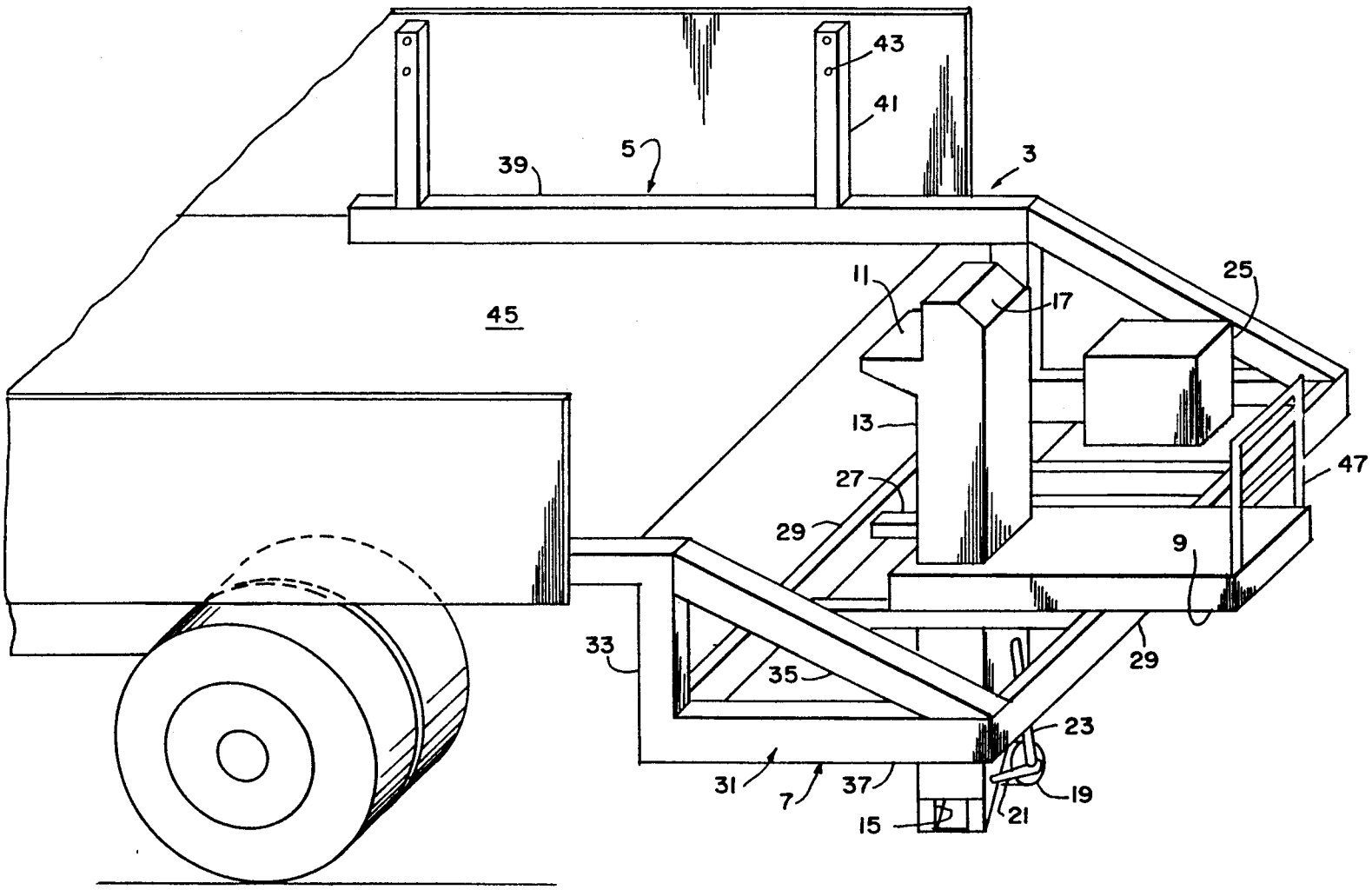
FIG. 1 is a schematic view of the apparatus of the present invention shown mounted on the back of a truck.

Referring to FIG. 1, a truck pavement patcher apparatus is generally indicated by the numeral 1. The patching apparatus has a frame 3 which has a truck-mounting portion 5 and a platform support portion 7. The platform support portion 7 is positioned below the frame truck-mounting portion 5 in a preferred embodiment of the invention.

A platform 9 moves sideways across the rear of the truck and forward and rearward to a lesser degree. The platform 9 has a hopper 11 with a chute 13, which has a lower opening 15 for delivering blacktop to a pothole. A control console panel 17 is mounted at the top of the chute to control the movement of the platform and the flow of patching material from the opening 15. A steel roller 19 is mounted on pivoted links 21 and rams 23 to lift the roller and to move the roller downward into contact with the pavement and to press the roller against the patch, using the force of the platform and frame and truck to seal the patch, as controlled by the console 17. When the roller 19 is forced into the downward position by rams 23, the operator moves the platform sideways to roll roller 19 over the patch.

A hydraulic package 25 mounted at one side of the frame includes a reservoir, a hydraulic pump, a motor and servo valves. The motor drives the pump to provide hydraulic fluid under pressure to operate the servo valves and rams, as regulated by control valves on the control panel 17.

The platform is moved sideways and forward and rearward with hydraulic jacks.

Platform 9 is supported on slides 27, which have ends mounted in rails 29. The platform rolls forward and rearward on the slides 27, and the slides 27 move sideways on the rails 29.

The rails are welded at their ends to ends 31, which are formed as a trusses, with vertical members 33, sloped members 35, and horizontal members 37. The truck-mounting frame portions 5 have elongated members 39 which extend into the bed of the truck, and have vertical members 41 which are bolted 43 to the frame in one preferred embodiment. Reinforcement plates may be welded or bolted to opposite sides of the truck frame or body to receive the bolts 43.

In an alternate embodiment, the truck-mounting portion is extended beneath the truck bed and engages the truck axle support frames. In a preferred alternate embodiment, the attachment frame portion 5 is configured for mounting in the place of a removed tailgate.

As shown in FIG. 1, the frame 3 may be mounted inside of the truck bed. Patching material may be raked from the truck bed 45 with the hopper, or the material may be shoveled from the bed 45 into the hopper 11.

A railing 47 is provided at the rear of the platform to provide a hand hold for the operator. An additional railing is provided along the side of the platform, and a hand hold is provided at the top of the chute 13 near the control console 17.

Figure 2:
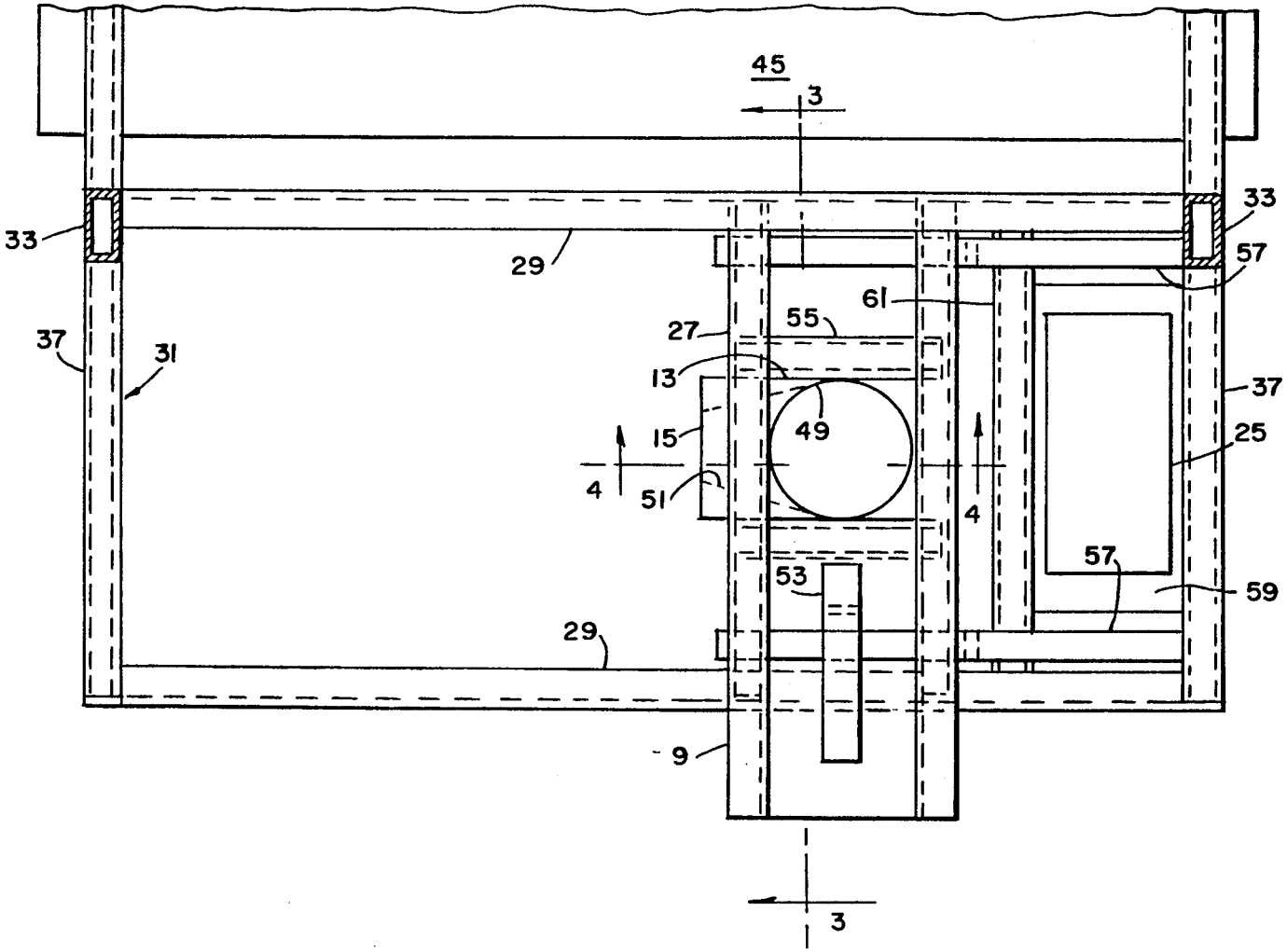
FIG. 2 is a schematic plan view of the present invention.

As shown in FIG. 2, the hopper may have a chute 13 with a circular center wall 49 of a cylindrical lower portion. The opening 15 at the bottom of the chute is tapered 51 to provide directional control of the blacktop patching material. Hydraulic jack 53 drives the platform and chute 13 forward and rearward in the direction of the truck as supported on cross-members 55. Hydraulic jacks 57 drive the platform across the back of the truck. The hydraulic pump assembly 25 is shown mounted on a shelf 59. The shelf is supported between a fixed member 61 and one of the end horizontal members 37.

As shown in the cross-section of the vertical members 33, the preferred structures of the support members are box beams.

Figure 3:
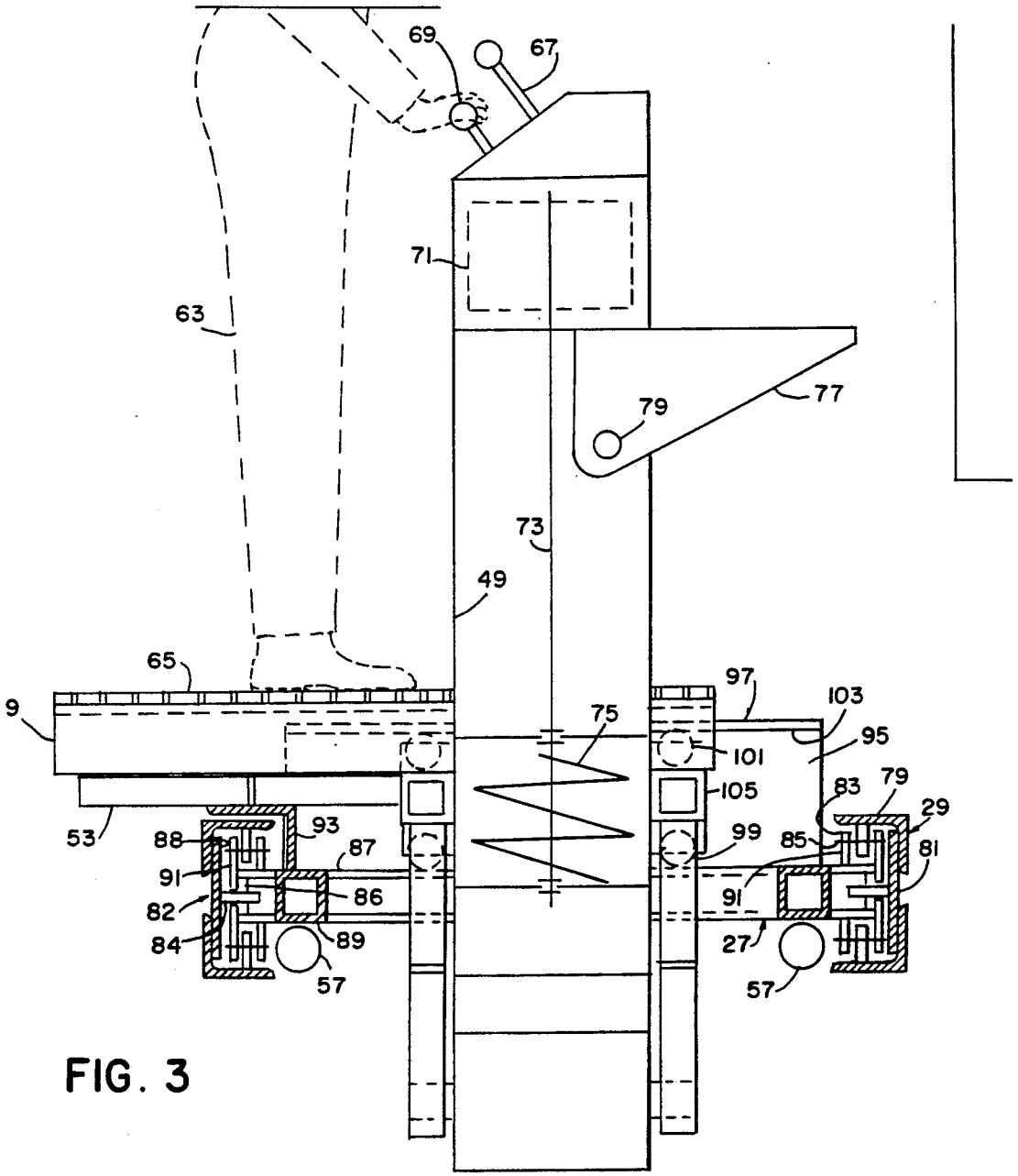
FIG. 3 is a schematic elevation of the present invention partially shown in section to show the preferred interrelationship of parts.

As shown in FIG. 3, an operator 63 is standing on the grating 65 of the platform 9, and the operator conveniently reaches the control lever 67 which operates the lateral and longitudinal movement of the platform. Control 69 operates the up and down movement of the roller 19 or other compactor. Another control supplies hydraulic fluid to the hydraulic motor 71, which drives a shaft 73 on which an auger 75 is mounted. The auger turns within the cylindrical chute wall 49 to drive the blacktop material downward and out of the chute.

The hopper may have a pivoted loading chute 77 mounted on pins 79, so that the chute may be placed downward to fill the main chute 13 and may be pivoted upward to avoid the truck bed when the platform is moved forward. In one embodiment, the loading chute 77 may be fixed at the upper end of the chute 13, and the position of the chute 77 may be raised to clear the truck bed when moved forward.

As shown in FIG. 3, the main support rails 29 are channels formed of angle irons 79 with welded connecting structural elements 81. The inner surfaces of the angle irons 79 and spacer elements 81 form the tracks for the carriages 82. Carriages, which have wheels 83 mounted on axles 85, roll within the inner surfaces of the angle irons 79 of the rails 29. Wheels 84 mounted on vertical axles 86 roll on inner surfaces 88 of the elements 81.

The slides 27 are connected as a rectangular frame with longitudinal members 87 and transverse members 89. The slide frames 27 are connected at their ends to extensions 91, which support the axles 85.

Hydraulic jacks 57 are connected between one end member 37 and the slide frames 27 to move the slide frames across the rear of the truck. The jacks may be telescoped or may be configured in any manner to move the platform the total designed travel distance.

The hydraulic jack 53 is mounted and welded on an angle piece 93 and moves the platform 9 forward and rearward on the slide frames 27. The slide frames include vertical members 95 with inward-facing flanges 97. Wheels 99 roll along the top of horizontal members 87, and wheels 101 roll along the bottom surface 103 of the flanges 97 to support the platform 9. Horizontal wheels 92 mounted on vertical axles 94, wheels 99 and 101, and other wheels are preferably made of steel cast or forged rollers with sealed self-lubricating bearings.

Box beams 105 are connected to the assemblies which mount the wheels 99 and 101 and are connected to the platform 9.

Figure 4:
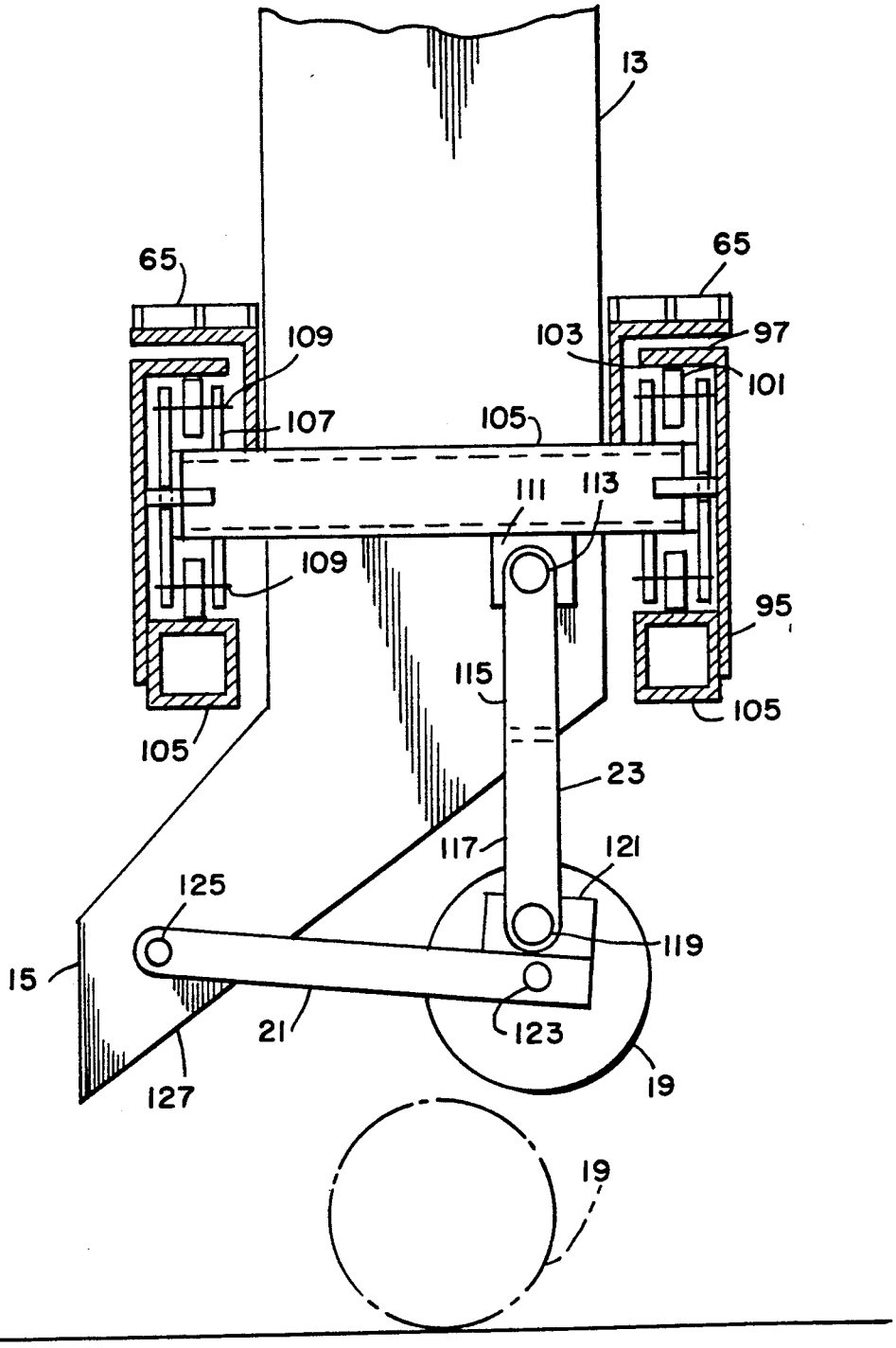
FIG. 4 is a detail of a lower portion of the chute and the roller schematically shown with the platform slide assembly shown in cross-section.

As shown in the detail of FIG. 4, the rectangular steel tubes or box beams 105 support vertical elements 107, which in turn hold the axles 109 on which the wheels 99 and 101 are mounted.

The box beams 105 also support bolsters 111 with pins 113 connected to the hydraulic cylinder portions 115 of the rams 23 which move the steel roller 19 upward and downward. The piston portions 117 are connected to pins 119, which in turn are connected to the reinforcements 121 on the links 21 to move the axles 123 of the rollers downward at the second ends of the links 21. The first ends of the links are pivoted on pins 125, which are mounted on reinforced walls 127 of the chute assemblies 13.

In operation, a truck driver steers his truck so that the truck will pass over a pothole. The operator then stops his truck at the approximate location of the pothole. The operator 63 may signal the truck driver with signaling switches on the control console 17 to move the truck forward or rearward or to stop the truck. The operator also may signal the driver when the patching work on a particular pothole has been completed so that the truck may be moved to the next potholes.

When the patching apparatus has been stopped over a pothole, the operator aligns the chute opening 15 with the pothole by moving the platform 9 sideways and forward and rearward. The operator then starts the hydraulic motor 71 to drive the auger 75, releasing the desired amount of material into the pothole. Then the operator stops the hydraulic motor 71 and operates the levers to lower the steel roller 19 by extending the rams 23. The downward force on the roller 19 is provided by the chute, by the platform assembly and by the frame, as well as by the weight of the truck to which the frame is connected, if necessary.

The operator then moves the platform 9 laterally back and forth, rolling the roller 19 over the top of the patch and sealing the patch. Then the operator lifts the rollers 19 using the rams 23, and moves the patching apparatus to a new pothole.

Other devices are added in modified versions. For example, a canopy or umbrella is mounted on the platform, or a fixed shade roof is mounted on the truck for daytime operation. A light mounted on the platform focused near the outlet of the hopper provides night operation accuracy. An aspirating tube may be positioned at one side of the hopper outlet and leading to a vacuum system in the truck bed for removing debris. An automatic wave-bouncing depth and volume device measures volume of a pothole in one embodiment. An imager may center the outlet over the hole and dump a predetermined amount in the hole. The roller operation is then automatically keyed to lower and roll the patch. The entire system in one embodiment is controlled from a remote operator's position in the bed of the truck with visual contact with the bin discharge opening. In another embodiment, the system is operated from within a cab using remote rear mounted cameras and a monitor and controls in the cab.

While the invention has been described with reference to specific embodiments, modifications and variations of the invention may be constructed without departing from the scope of the invention, which is defined in the following claims.

We claim:

1. A pavement patching apparatus comprising a frame for supporting on a back of a truck, and operator's platform movably mounted on the frame, means for moving the platform horizontally across the frame between first and second sides of the truck parallel to the back, and moving transversely upwards and downwards along the back of the truck, and means for moving the platform longitudinally towards and away with respect to the back of the truck on the frame for a relatively shorter distance, an integrally formed hydraulic control console on the platform, an integrally formed blacktop hopper on the platform, a hydraulic rotor connected to the hopper and an auger connected to the hydraulic rotor and mounted within the hopper for moving the blacktop material through the hopper as the hydraulic rotor rotates, a side delivery opening at the bottom of the hopper for dispensing blacktop from the hopper to a pavement hole, a hydraulic roller mounted on the platform and extensible below the platform into contact with blacktop over the hole for pressing the blacktop into the hole under the pressure of the roller.

2. The apparatus of claim 1, wherein the frame has a mounting portion which is connected to the truck, and a platform portion which is mounted on an end of the truck-connecting portion and which extends generally horizontally below a plane of the truck bed.

3. The apparatus of claim 1, further comprising a shelf mounting the hydraulic package, including a pump and reservoir and motor mounted on one end of the platform portion of the frame along one edge of the truck.

4. The apparatus of claim 3, wherein the platform portion of the frame comprises first and second parallel rails, and first and second carriage means respectively mounted on the first and second rails.

5. The apparatus of claim 4, wherein the platform further comprises first and second slides having opposite ends connected to the first and second carriages for moving the spaced slides transversely across a back of the truck on the platform portion of the frame.

6. The apparatus of claim 5, wherein the platform is mounted on the slides on bearings for allowing forward and aft movement of the platform on the slides.

7. The apparatus of claim 6, wherein the platform includes an operator's stand and wherein the hopper includes a vertical chute with an upper opening for receiving blacktop from a bed of the truck, and wherein the control console is mounted on an upper end of the chute, whereby the operators stand and the chute and the console move back and forth with the platform on the slides.

8. The apparatus of claim 7, wherein the chute has first and second parallel links with first ends connected to front and rear sides of the chute near a bottom thereof, and wherein the roller has an axle connected to second ends of the first and second links for pivoting on the links with respect to the lower end of the chute, and further comprising rams connected to the axle of the roller and to the platform for respectively lifting the roller away from pavement and forcing the roller toward the pavement against the downward pressure of the platform and frame and truck for sealing blacktop deposited in a pothole from the chute.

9. A method of filling potholes comprising filling a hopper from a truck bed, driving a truck into position where a pothole is in back of a truck, moving an integrally formed platform hopper and chute downwards transversely across and to or from a truck bed until the opening at a bottom of the chute is aligned with a pothole, releasing blacktop from the chute, lowering a roller into the surface of the blacktop and pressing the roller in the direction of the pavement, moving the roller, chute and platform simultaneously transversely with respect to the truck and sealing the blacktop in the pothole.

10. The method of claim 9, further comprising moving the platform hopper and chute longitudinally with respect to the truck on a frame.

11. A pavement patching apparatus comprising a frame for supporting on a back of a truck, a platform movably mounted on the frame, means for moving the platform horizontally between first and second lateral sides of the truck across the frame, transversely upwards and downwards along the back of the truck and longitudinally towards and away from the truck, an integrally formed hydraulic control console on the platform, an integrally formed patching material hopper on the platform, a rotor connected to the hopper and an auger connected to the rotor and mounted within the hopper for moving the material through the hopper as the rotor rotates, a delivery opening at the bottom of the hopper for dispensing from the hopper to a pavement hole, a compactor mounted on the platform and extensible below the platform into contact with material in the hole for pressing the material into the hole under the pressure of the compactor.

* * * * *